US009526396B2

(12) United States Patent
Aras et al.

(10) Patent No.: US 9,526,396 B2
(45) Date of Patent: Dec. 27, 2016

(54) DISHWASHER WHEREIN OZONE WASH IS APPLIED

(75) Inventors: Nasir Efe Aras, Istanbul (TR); Huseyin Caliskan, Istanbul (TR); Orhan Atabey, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 312 days.

(21) Appl. No.: 13/977,619

(22) PCT Filed: Dec. 7, 2011

(86) PCT No.: PCT/EP2011/072021

§ 371 (c)(1),
(2), (4) Date: Sep. 23, 2013

(87) PCT Pub. No.: WO2012/089462

PCT Pub. Date: Jul. 5, 2012

(65) Prior Publication Data

US 2014/0196752 A1 Jul. 17, 2014

(30) Foreign Application Priority Data

Dec. 28, 2010 (TR) ..... a 2010 11028

(51) Int. Cl.
*A47L 15/42* (2006.01)
*D06F 35/00* (2006.01)

(52) U.S. Cl.
CPC ..... *A47L 15/424* (2013.01); *D06F 35/001* (2013.01); *A47L 2601/08* (2013.01)

(58) Field of Classification Search
CPC ... A47L 15/424; A47L 2601/08; D06F 35/001
USPC ..... 134/102.1
See application file for complete search history.

(56) References Cited

U.S. PATENT DOCUMENTS 4,641,671 A * 2/1987 Nogi et al. ..... 134/57 D
5,960,649 A * 10/1999 Burdick ..... D06F 35/001 68/12.12
2007/0251549 A1* 11/2007 Heiligenmann .... A47L 15/0015 134/31

(Continued)

FOREIGN PATENT DOCUMENTS

DE 3000826 A1 7/1981
DE 3232057 A1 3/1984

(Continued)

OTHER PUBLICATIONS

DE 10 2008024322—Machine translation of Description on Jan. 8, 2015.*

(Continued)

*Primary Examiner* — Michael Barr
*Assistant Examiner* — Rita Adhlakha
(74) *Attorney, Agent, or Firm* — Kilpatrick Townsend & Stockton LLP

(57) ABSTRACT

A dishwasher is described having the ozone generator (6) connected to the suction line (4) prior to the circulation pump (3), the ozone gas generated by the ozone generator (6)is provided to be sucked through the connection hose (7) with the vacuum effect created by the circulation pump (3), the dissolvability of ozone gas in the washing liquid is increased with the vortex effect of the motor (11) since the washing water-ozone gas mixture flows through the circulation pump (3).

16 Claims, 2 Drawing Sheets

(56) References Cited

U.S. PATENT DOCUMENTS

Figure 1:
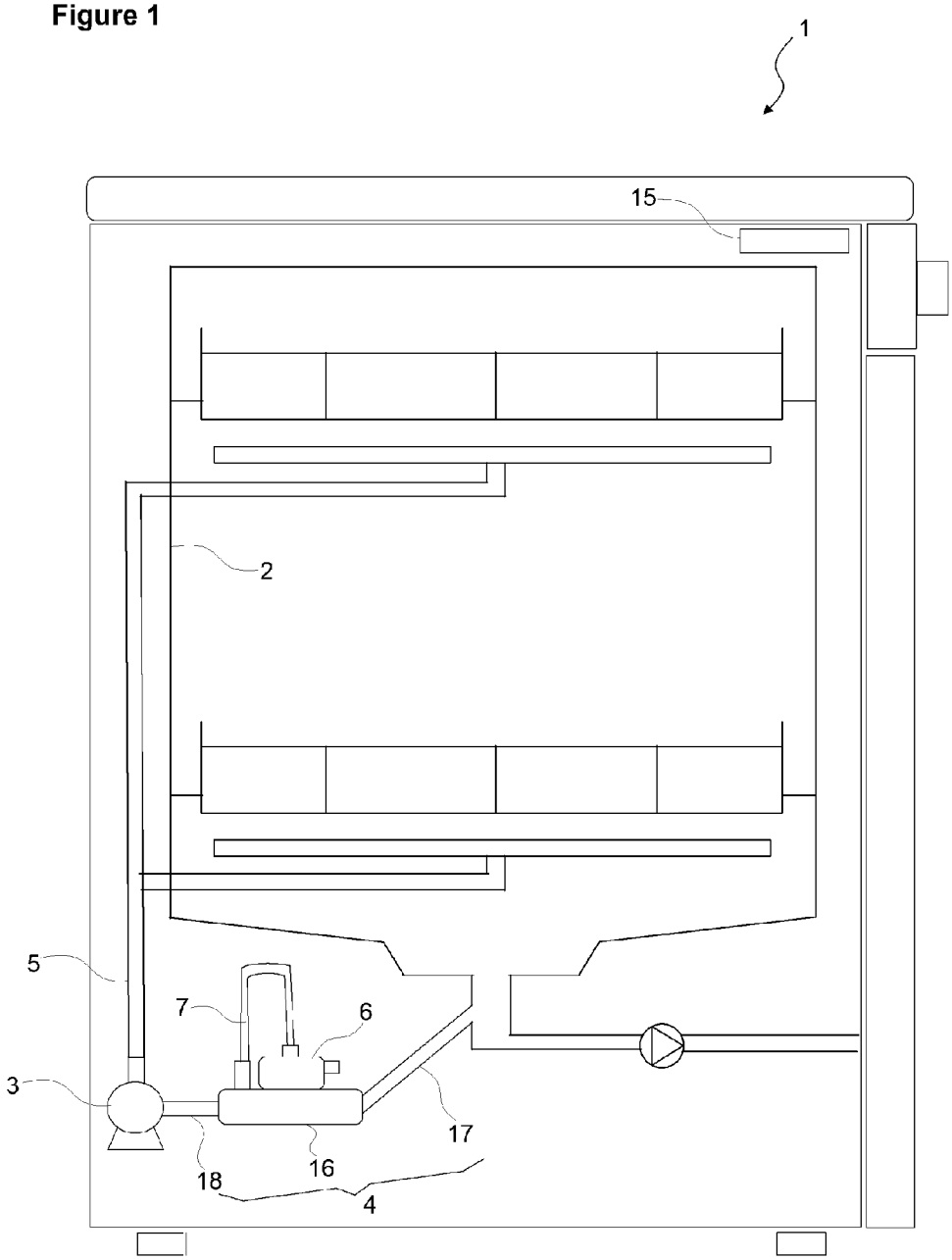

2011/0203620 A1* 8/2011 Ulger et al. ..... 134/184

FOREIGN PATENT DOCUMENTS

| | | | |
|---|---|---|---|
| DE | 102008024322 | A1 | 11/2009 |
| EP | 1701644 | B1 | 11/2009 |
| WO | 2010/049318 | A1 | 1/2010 |

OTHER PUBLICATIONS

International Search Report and Written Opinion for PCT/EP2011/072021 (submitted with application) and documents cited therein except for any documents that may not qualify as prior art.

* cited by examiner

DISHWASHER WHEREIN OZONE WASH IS APPLIED

The present invention relates to a dishwasher wherein ozone wash is applied.

In dishwashers, ozone gas ($O_3$) having disinfectant and soil removal effects is used for increasing the effectiveness of the washing process. By means of the ozone gas used in the washing process, the detergent and water consumptions decrease and energy saving is provided since the washing process can be performed at lower temperature levels. In dishwashers performing ozone washing, the ozone gas generated by an ozone generator, is dissolved generally in the washing water and the washing process is performed by the ozonized water being sent onto the dishes. In the washing process performed with ozonized water, dissolvability of ozone effectively in the washing water affects the washing performance. There are state of the art studies performed in order to provide effective dissolving of the ozone in the washing liquid.

In the Patent Document No. DE3232057, an ozone generator is described that is used in washing machines and dishwashers. In the dishwasher, the ozone gas received from the ozone generator to the washing line by means of the vacuum pump is dissolved in the washing water in the rinsing step and the dishes are washed with ozonized water.

In the Patent Application No. EP1701644, the usage of oxygenating gases such as ozone in a dishwasher for the purpose of cleaning and disinfecting is described. The ozone gas is dissolved in the rinsing liquor and/or directly delivered to the washing container. Furthermore, the effectiveness of the ozone gas is increased by being mixed with cold fog generated by an ultrasonic generator.

In the Patent Application No. DE3000826, ozone gas is used in the washing process in a dishwasher. The ozone gas generated by an ozone generator is mixed with water and the wash water comprising ozone gas is delivered into the compartment wherein the washing process is performed by means of a sprayer.

The aim of the present invention is the realization of a dishwasher wherein ozone wash is implemented and the dissolvability of ozone in the washing liquid is improved.

With the dishwasher realized in order to attain the aim of the present invention and explicated in the claims, the washing water-ozone gas mixture is provided to be directed into the washing tub after passing through the circulation pump by means of disposing the ozone generator in the suction line of the circulation pump and prior to the circulation pump. Thus, the amount of ozone gas dissolved in the washing water is increased by means of vortexes formed in the chamber of the circulation pump due to the effect of the motor.

The suction of the ozone gas generated in the ozone generator into water is provided with the vacuum effect created by the circulation pump. In order to strengthen this effect, the ozone generator is disposed at the same level or at a higher level than the circulation pump in the horizontal plane.

The connection hose extending between the ozone generator and the suction line is connected to a point at the upper side of the suction line. Thus, the connection hose does not remain below the upper level of the washing water flowing through the suction line at the point of connection and water is prevented from leaking into the connection hose.

In an embodiment of the present invention, the circulation pump comprises a variable speed motor. The rotational speed of the motor is regulated by the control unit and the amount of ozone gas sucked is changed.

In another embodiment of the present invention, the ozone generator is mounted on the suction line. In this embodiment, the suction line comprises a pipe-shaped support that does not change shape under force in order to support the weight of the ozone generator.

In the dishwasher of the present invention, by means of connecting the ozone generator to the suction line prior to the circulation pump, the ozone gas generated by the ozone generator is provided to be sucked with the vacuum effect created by the circulation pump, the dissolvability of ozone gas in the washing water is increased with the vortex effect of the motor since the washing water-ozone gas mixture flows through the circulation pump.

The dishwasher realized in order to attain the aim of the present invention is illustrated in the attached figures, where:

FIG. 1—is the schematic view of a dishwasher wherein ozone washing is implemented.

Figure 2:
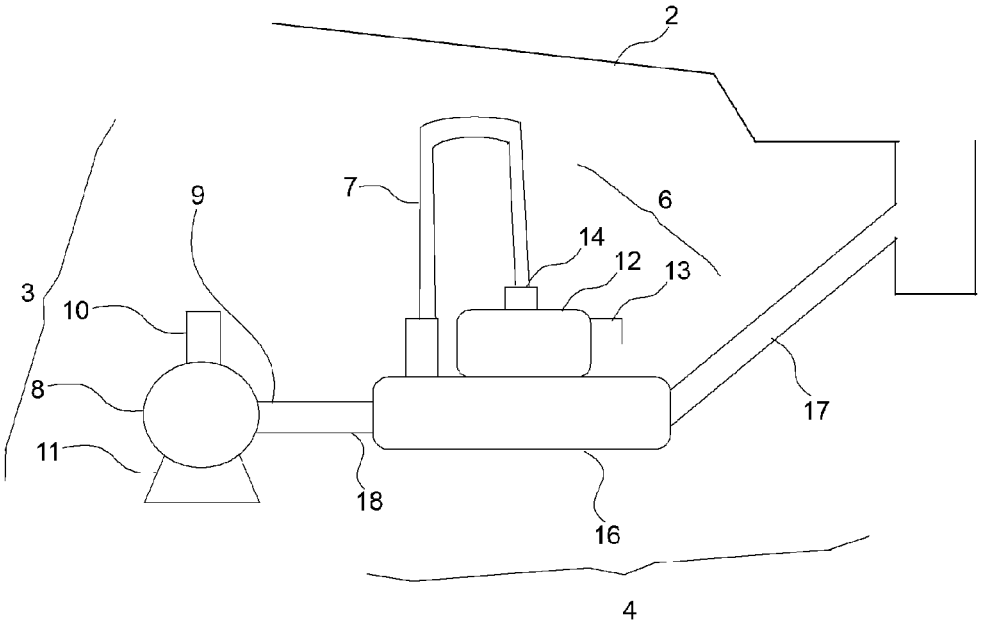

FIG. 2—is the schematic detailed view of an ozone generator and a circulation pump.

Figure 3:
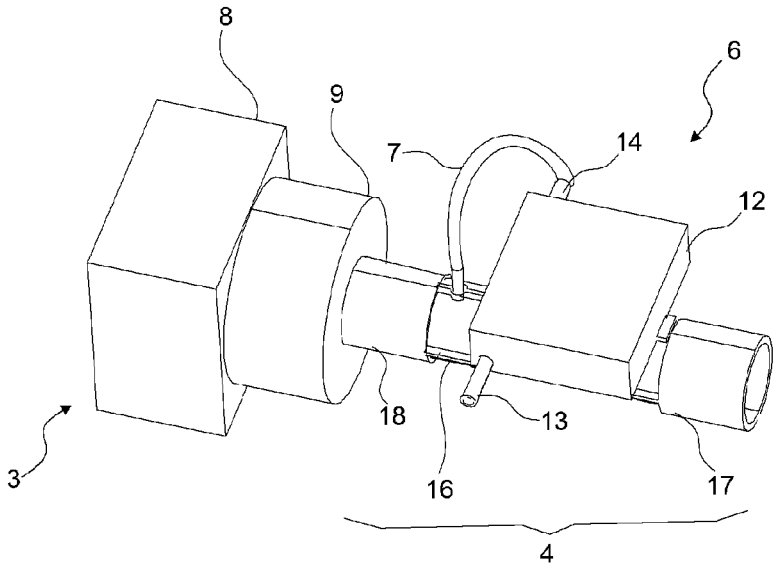

FIG. 3—is the perspective view of an ozone generator and a circulation pump.

The elements illustrated in the figures are numbered as follows:

1. Dishwasher
2. Washing tub
3. Circulation pump
4. Suction line
5. Delivery line
6. Ozone generator
7. Connection hose
8. Container
9. Suction port
10. Pumping port
11. Motor
12. Body
13. Inlet
14. Outlet
15. Control unit
16. Support
17. First hose
18. Second hose The dishwasher (1) comprises a washing tub (2) wherein the washing process is performed, a circulation pump (3) that provides circulation of the washing water, a suction line (4) arranged between the washing tub (2) and the circulation pump (3), a delivery line (5) providing the washing water to be transferred from the circulation pump (3) and an ozone generator (6) that generates the ozone gas used for increasing effectives of the washing process and for providing hygiene (FIG. 1 and FIG. 2).

The ozone generator (6) is connected prior to the circulation pump (3) in order to increase suction rate of ozone gas into water. Ozone gas is provided to be sucked by the circulation pump (3) by means of connecting the ozone generator (6) to the suction line (4) prior to the circulation pump (3).

The dishwasher (1) comprises a connection hose (7) with one end connected to the ozone generator (6), the other end to the suction line (4).

As the circulation pump (3) operates, the ozone gas generated by the ozone generator (6) mixes into the washing water with the vacuum effect created by the washing water that is sucked from the washing tub (2) and flowing in the suction line (4). The washing water mixed with the ozone gas in the suction line (4) is directed to the delivery line (5)

by means of the circulation pump (3). The ozone gas dissolves in the circulation pump (3) with the vortex effect and thus the washing performance is increased.

The ozone generator (6) is positioned at the same level with the circulation pump (3) or at a higher level than the circulation pump (3) in order to facilitate the suction of ozone gas (FIG. 3 and FIG. 4).

The end of the connection hose (7) connected to the suction line (4) is connected to the upper side of the suction line (4) so as not to remain below the upper level of the washing water flowing through the suction line (4) at the point of connection. Consequently, the washing liquid is prevented from being directed from the suction line (4) to the ozone generator (6) when the ozone generator (6) is not operating.

The circulation pump (3) comprises a container (8), a suction port (9) disposed on the container (8) whereto the suction line (4) is connected, a pumping port (10) disposed on the container (8) whereto the delivery line (5) is connected and a motor (11) disposed inside the container (8) that directs the washing liquid sucked from the suction port (9) to the pumping port (10).

The ozone generator (6) comprises a body (12), an inlet (13) disposed on the body (12) wherefrom air is sucked from the outside and an outlet (14) disposed on the body (12) whereto the connection hose (7) is connected and wherefrom the ozone gas is sucked by the circulation pump (3).

The connection hose (7) is bent so as to form a siphon shape by means of its flexible configuration and thus the washing liquid in the suction line (4) is prevented to be directed from the suction line (4) to the ozone generator (6).

In an embodiment of the present invention, the motor (11) is of variable speed. The dishwasher (1) comprises a control unit (15). The rotational speed of the motor (11) and the operating range of the ozone generator (6) are controlled by the control unit (15). When the ozone generator (6) is operated, the motor (11) rotational speed is increased to the level whereat ozone gas is sucked into the suction line (4). The amount of ozone gas sucked from the ozone generator (6) to the suction line (4) by means of the connection hose (7) changes depending on the rotational speed of the motor (11) and operation duration of the ozone generator (6).

In another embodiment of the present invention, the suction line (4) comprises a pipe-shaped support (16), a first hose (17), one end connected to the washing tub (2), the other end to the inlet of the support (16) and a second hose (18), one end connected to the outlet of the support (16), the other end to the suction port (9). The ozone generator (6) is placed on the outer surface of the support (16). The possibility of the ozone generator (6) and the suction line (4) moving with respect to each other is eliminated by mounting the ozone generator (6) on the suction line (4). Consequently, the suction of the ozone gas is provided to be accomplished in a consistent manner. The support (16) while providing the washing liquid to be delivered by means of its pipe-shaped configuration also supports the ozone generator (6) due to its rigid structure.

In another embodiment of the present invention, the distance between the suction port (9) and the point where the connection hose (7) is connected on the suction line (4) is between 50 mm and 100 mm. When the distance between the point where the connection hose (7) is connected on the suction line (4) and the suction port (9) is decreased, vacuum effect is created at the inlet (13) with the vacuum effect created by operation of the motor (11) when the ozone generator (6) is not in operation, the outside air sucked from the inlet (13) reaches the suction line (4) by means of the connection hose (7) and decreases operational efficiency of the circulation pump (3). When the distance between the point where the connection hose (7) is connected on the suction line (4) and the suction port (9) is increased, the efficiency of ozone gas suction from the ozone generator (6) decreases. Suction of ozone gas is provided by changing the rotational speed of the variable speed motor (11) to be between 2800 rpm and 3400 rpm.

With the present invention, by means of connecting the ozone generator (6) to the suction line (4) prior to the circulation pump (3) in dishwashers (1), the ozone gas generated by the ozone generator (6) is provided to be sucked through the connection hose (7) with the vacuum effect created by the circulation pump (3), the dissolvability of ozone gas in the washing liquid is increased with the vortex effect of the motor (11) since the washing water-ozone gas mixture flows through the circulation pump (3).

It is to be understood that the present invention is not limited to the embodiments disclosed above and a person skilled in the art can easily introduce different embodiments. These different embodiments should also be considered within the scope of the claims of the present invention.

The invention claimed is:

1. A dishwasher (1) comprising a washing tub (2) wherein the washing process is performed, a circulation pump (3) that provides circulation of the washing water, a suction line (4) arranged between the washing tub (2) and the circulation pump (3), a delivery line (5) providing the washing water to be transferred from the circulation pump (3) and an ozone generator (6) that generates the ozone gas used for increasing effectives of the washing process and for providing hygiene, characterized by the ozone generator (6) connected prior to the circulation pump, wherein the ozone generator (6) is formed between the tub (2) and the circulation pump (3), and wherein the circulation pump (3) comprises a container (8), a suction port (9) disposed on the container (8) whereto the suction line (4) is connected, a pumping port (10) disposed on the container (8) whereto the delivery line (5) is connected and a variable speed motor (11) disposed inside the container (8) that directs the washing liquid sucked from the suction port (9) to the pumping port (10) and a control unit (15) that controls the rotational speed of the variable speed motor (11) so as to increase to the level where ozone gas is sucked into the suction line (4).

2. The dishwasher (1) as in claim 1, further comprising a connection hose (7), one end connected to the ozone generator (6), the other end to the suction line (4).

3. The dishwasher (1) as in claim 2, wherein the ozone generator (6) is positioned at the same level with the circulation pump (3) or at a higher level than the circulation pump (3).

4. The dishwasher (1) as in claim 3, wherein the connection hose (7) the end of which connected to the suction line (4) is connected to the upper side of the suction line (4).

5. The dishwasher (1) as in claim 4 wherein the ozone generator (6) comprising a body (12), an inlet (13) disposed on the body (12) wherefrom air is sucked from the outside and an outlet (14) disposed on the body (12) whereto the connection hose (7) is connected and wherefrom the ozone gas is sucked by the circulation pump (3).

6. The dishwasher (1) as in claim 5, wherein the connection hose (7) is flexibly configurable and is at least partially bent in siphon shape.

7. The dishwasher (1) as in claim 4, wherein the ozone generator (6) comprising a body (12), an inlet (13) disposed on the body (12) wherefrom air is sucked from the outside and an outlet (14) disposed on the body (12) whereto the connection hose (7) is connected and wherefrom the ozone gas is sucked by the circulation pump (3).

8. The dishwasher (1) as in claim 7, wherein the connection hose (7) is flexibly configurable and is at least partially bent in siphon shape.

9. The dishwasher (1) as in claim 3, wherein the ozone generator (6) comprising a body (12), an inlet (13) disposed on the body (12) wherefrom air is sucked from the outside and an outlet (14) disposed on the body (12) whereto the connection hose (7) is connected and wherefrom the ozone gas is sucked by the circulation pump (3).

10. The dishwasher (1) as in claim 2, wherein the connection hose (7) the end of which connected to the suction line (4) is connected to the upper side of the suction line (4).

11. The dishwasher (1) as in claim 2, wherein the ozone generator (6) comprising a body (12), an inlet (13) disposed on the body (12) wherefrom air is sucked from the outside and an outlet (14) disposed on the body (12) whereto the connection hose (7) is connected and wherefrom the ozone gas is sucked by the circulation pump (3).

12. The dishwasher (1) as in claim 2, wherein the connection hose (7) is flexibly configurable and is at least partially bent in siphon shape.

13. The dishwasher (1) as in claim 1, wherein the ozone generator (6) is positioned at the same level with the circulation pump (3) or at a higher level than the circulation pump (3).

14. The dishwasher (1) as in claim 13, further comprising a connection hose (7) the end of which connected to the suction line (4) is connected to the upper side of the suction line (4).

15. The dishwasher (1) as in claim 1, wherein the circulation pump (3) comprising a container (8), a suction port (9) disposed on the container (8) whereto the suction line (4) is connected, a pumping port (10) disposed on the container (8) whereto the delivery line (5) is connected and a motor (11) disposed inside the container (8) that directs the washing liquid sucked from the suction port (9) to the pumping port (10).

16. The dishwasher (1) as in claim 15, wherein the motor (11) having a variable speed and a control unit (15) that controls the rotational speed of the motor (11) so as to increase to the level where ozone gas is sucked into the suction line (4).

* * * * *